US009157259B2

(12) United States Patent
Johnson et al.

(10) Patent No.: US 9,157,259 B2
(45) Date of Patent: Oct. 13, 2015

(54) VEHICLE HOOD LATCH ASSEMBLY

(75) Inventors: Lawrence W. Johnson, Taylor, MI (US); Alexander W. Sherrill, Hendersonville, TN (US); Nicholas Capito, Jr., Whittier, CA (US); Frank P. Romero, Rancho Cucamonga, CA (US); Irma Romero, legal representative, Rancho Cucamonga, CA (US)

(73) Assignee: Illinois Tool Works Inc., Glenview, IL (US)

( * ) Notice: Subject to any disclaimer, the term of this patent is extended or adjusted under 35 U.S.C. 154(b) by 317 days.

(21) Appl. No.: 13/807,087

(22) PCT Filed: Jun. 24, 2011 (Under 37 CFR 1.47)

(86) PCT No.: PCT/US2011/041814

§ 371 (c)(1), (2), (4) Date: Feb. 24, 2013

(87) PCT Pub. No.: WO2012/003143

PCT Pub. Date: Jan. 5, 2012

(65) Prior Publication Data

US 2013/0193694 A1 Aug. 1, 2013

Related U.S. Application Data

(60) Provisional application No. 61/359,578, filed on Jun. 29, 2010, provisional application No. 61/412,629, filed on Nov. 11, 2010.

(51) Int. Cl.
*E05C 9/00* (2006.01)
*E05B 83/24* (2014.01)
(Continued)

(52) U.S. Cl.
CPC ..... *E05B 83/24* (2013.01); *Y10T 292/0833* (2015.04)

(58) Field of Classification Search
CPC ..... Y10T 16/3816; Y10T 24/45508; Y10T 24/45644
USPC ..... 292/31, 340, 341, 341.13, 341.15, 292/341.17, 216, DIG. 14, DIG. 42; 180/69.2, 69.21
See application file for complete search history.

(56) References Cited

U.S. PATENT DOCUMENTS 512,766 A * 1/1894 Tubach ..... 292/80
934,792 A * 9/1909 Card ..... 220/326
(Continued)

FOREIGN PATENT DOCUMENTS

CN 2349321 Y 11/1999
DE 102004063239 A1 1/2006
GB 2347458 A 9/2000

OTHER PUBLICATIONS

An International Search Report, dated Sep. 16, 2011 in International Application No. PCT/US2011/041814.

*Primary Examiner* — Kristina Fulton
*Assistant Examiner* — Faria Ahmad

(57) ABSTRACT

A hood latch assembly configured to securely latch a striker bar of a hood to a main frame of a vehicle includes a main body having a moveable secondary latch pivot arm, and a moveable primary latch member. The primary latch member is configured to secure the striker bar in a primary closed position, and the secondary latch pivot arm is configured to secure the striker bar in a secondary closed position above the primary latch member.

18 Claims, 11 Drawing Sheets

(51) Int. Cl.

| | |
|---|---|
| *E05C 19/06* | (2006.01) |
| *E05C 3/06* | (2006.01) |
| *E05C 3/16* | (2006.01) |

(56) References Cited

U.S. PATENT DOCUMENTS

| | | | | | |
|---|---|---|---|---|---|
| 1,160,505 | A | * | 11/1915 | Giles | 292/87 |
| 1,469,659 | A | * | 10/1923 | McGuire | 292/194 |
| 1,497,879 | A | * | 6/1924 | Richardson | 292/95 |
| 1,530,385 | A | * | 3/1925 | McGuire | 292/207 |
| 1,578,386 | A | * | 3/1926 | Bingham | 292/219 |
| 2,508,090 | A | * | 5/1950 | Beems et al. | 292/129 |
| 2,646,299 | A | * | 7/1953 | Kramer | 292/44 |
| 2,793,061 | A | * | 5/1957 | Dall | 292/6 |
| 2,809,064 | A | * | 10/1957 | Dlugatch | 292/226 |
| 2,834,626 | A | * | 5/1958 | Claud-Mantle | 292/52 |
| 2,864,635 | A | * | 12/1958 | Lindner | 292/12 |
| 2,877,038 | A | * | 3/1959 | Kramer | 292/216 |
| 3,743,335 | A | * | 7/1973 | Reilhac et al. | 292/127 |
| 3,918,753 | A | * | 11/1975 | McCormack et al. | 292/216 |
| 4,416,126 | A | * | 11/1983 | Remington | 70/71 |
| 4,756,562 | A | * | 7/1988 | Foster et al. | 292/28 |
| 4,875,724 | A | * | 10/1989 | Gruber | 292/216 |
| 4,917,417 | A | * | 4/1990 | Aubry | 292/117 |
| 4,936,611 | A | * | 6/1990 | Palvolgyi | 292/28 |
| 4,961,601 | A | * | 10/1990 | Lindholm et al. | 292/216 |
| 4,991,884 | A | * | 2/1991 | Cairns | 292/28 |
| 5,046,768 | A | * | 9/1991 | Myslicki | 292/68 |
| 5,048,877 | A | * | 9/1991 | Rogers et al. | 292/110 |
| 5,150,933 | A | * | 9/1992 | Myslicki et al. | 292/216 |
| 5,172,945 | A | * | 12/1992 | Doherty et al. | 292/49 |
| 5,348,355 | A | * | 9/1994 | Oyha | 292/11 |
| 5,431,460 | A | * | 7/1995 | Hass et al. | 292/216 |
| 5,445,421 | A | * | 8/1995 | Ferrara | 292/216 |
| 5,618,069 | A | * | 4/1997 | Konchan et al. | 292/216 |
| 5,738,393 | A | * | 4/1998 | Chao | 292/216 |
| 5,853,060 | A | * | 12/1998 | Chao et al. | 180/69.2 |
| 6,070,921 | A | * | 6/2000 | Valasin | 292/216 |
| 6,106,033 | A | * | 8/2000 | Ruckert | 292/216 |
| 6,149,210 | A | * | 11/2000 | Hunt et al. | 292/216 |
| 6,422,616 | B1 | * | 7/2002 | Wortmann et al. | 292/216 |
| 6,485,071 | B2 | * | 11/2002 | Schwaiger | 292/216 |
| 6,581,987 | B1 | * | 6/2003 | Gentile et al. | 292/216 |
| 6,666,483 | B2 | * | 12/2003 | Baniak et al. | 292/123 |
| 7,204,526 | B2 | * | 4/2007 | Seo | 292/24 |
| 7,261,337 | B2 | * | 8/2007 | Nakagome et al. | 292/216 |
| 7,533,911 | B2 | * | 5/2009 | Homner | 292/63 |
| 7,585,006 | B2 | * | 9/2009 | Alacqua et al. | 292/341.16 |
| 7,845,691 | B2 | * | 12/2010 | Sundararajan et al. | 292/216 |
| 8,047,585 | B1 | * | 11/2011 | Peabody et al. | 292/341.16 |
| 8,083,270 | B2 | * | 12/2011 | Hwang | 292/128 |
| 8,096,594 | B2 | * | 1/2012 | Uyeda | 292/341.15 |
| 8,469,440 | B2 | * | 6/2013 | Thorpe et al. | 296/146.9 |
| 8,534,745 | B1 | * | 9/2013 | Quinn et al. | 296/146.9 |
| 8,573,658 | B2 | * | 11/2013 | Kim | 292/201 |
| 8,608,221 | B1 | * | 12/2013 | Krajenke et al. | 296/76 |
| 8,646,816 | B2 | * | 2/2014 | Dziurdzia et al. | 292/201 |
| 8,690,591 | B2 | * | 4/2014 | Charnesky et al. | 439/153 |
| 8,894,107 | B2 | * | 11/2014 | Kamata et al. | 292/216 |
| 2003/0122382 | A1 | | 7/2003 | Baniak et al. | |
| 2009/0121500 | A1 | * | 5/2009 | Halliwell | 292/341.15 |
| 2010/0237632 | A1 | * | 9/2010 | Browne et al. | 292/201 |
| 2012/0306237 | A1 | * | 12/2012 | Farooq et al. | 296/193.11 |
| 2013/0031844 | A1 | * | 2/2013 | Quinn et al. | 49/503 |

* cited by examiner

VEHICLE HOOD LATCH ASSEMBLY

RELATED APPLICATIONS

This application relates to and claims priority benefits from U.S. Provisional Patent Application No. 61/359,578 entitled "Hood Latch Assembly," filed Jun. 29, 2010, and U.S. Provisional Patent Application No. 61/412,629 entitled "Hood Latch Assembly," filed Nov. 11, 2010, both of which are hereby incorporated by reference in their entireties.

FIELD OF EMBODIMENTS OF THE INVENTION

Embodiments of the present invention generally relate to a vehicle hood latch assembly, and, more particularly, to a vehicle hood latch assembly that is configured to secure a hood in primary and secondary positions.

BACKGROUND

Vehicles, such as automobiles, typically include a hood that is pivotally secured to a main structural frame. The hood covers an engine, for example. During vehicle operation, the hood is secured in a closed position such that it does not pivot into an open position.

FIG. 1 illustrates an isometric view of a front end of a vehicle 10. The vehicle 10 includes a main structural frame 12 and a hood 14 that is pivotally secured to the frame 12. In order to gain access to an engine chamber 16 of the vehicle 10, the hood 14 is pivoted into an open position. Typically, an operator engages (pulls, for example) a hood release activation handle (not shown) within the cockpit of the vehicle 10. The hood release activation handle is typically connected to a cable that is, in turn, connected to a portion of a hood latch assembly 18 secured to a front upper portion of the frame 12.

When the hood release activation handle is engaged, the hood latch assembly 18 releases a striker bar 20 extending underneath a front edge of the hood 14, thereby propping the hood 14 up a small distance above the frame 12. The operator may then position a hand within the clearance area, engage the hood latch assembly 18 so that it fully releases the striker bar 20, and pivot the hood up into a fully open position (and brace the hood open by way of a brace bar pivotally secured to the frame).

When the operator is finished inspecting the engine chamber 16, the operator may then allow the hood 14 to fall back toward the frame 12. The force of the hood 14 falling into the frame secures the striker bar 20 to the hood latch assembly 18 so that the hood 14 is securely fastened to the frame 12.

Typically, the hood latch assembly 18 includes numerous separate and distinct components. For example, the hood latch assembly 18 includes an 8-piece assembly having traditional wire springs, sheet metal stampings, and assembly rivets. Accordingly, the process of manufacturing the hood latch assembly 18 may be time and labor intensive. Additionally, the high number of separate and distinct parts increases the likelihood of individual components degrading or otherwise breaking.

SUMMARY OF EMBODIMENTS OF THE INVENTION

Embodiments of the present invention provide a hood latch assembly of a simpler and more efficient design that includes far fewer separate and distinct components than a typical hood latch assembly.

Certain embodiments of the present invention provide a hood latch assembly configured to securely latch a striker bar of a hood to a main frame of a vehicle. The assembly includes a main body including a moveable secondary latch member, and a moveable primary latch member. The primary latch member is configured to secure the striker bar in a primary closed position. The secondary latch member is configured to secure the striker bar in a secondary closed position above the primary latch member.

The main body, the secondary latch member, and the primary latch member may be integrally formed as a single piece from a single piece of material.

The assembly may also include a coil spring retained within the main body. The coil spring is configured to exert a resistive force into the striker bar. A cushioning cap may be secured to a top of the coil spring.

The primary latch member may include a primary latch pivot arm having opposed flanges. The primary latch member may be configured to pivot away from the main body when pulled by a cable that is operatively connected to a hood release activation handle.

The secondary latch member may include a secondary latch pivot arm having opposed slide ramps and an integral handle. The secondary latch member may be configured to pivot away from the main body when an operator grasps and pulls the integral handle away from the main body.

In general, the primary latch member may be configured to pivot away from the main body in a first direction to disengage the striker bar, and the secondary latch member may be configured to pivot away from the main body in a second direction to disengage the striker bar, wherein the first direction is opposite that of the second direction.

The main body may securely fasten to the main frame of the vehicle through a single fastener. Additionally, the primary and secondary latch members may be configured to interlock with one another when the striker bar is fully engaged by the primary latch member.

Optionally, the primary latch member may include a rotary compression spring. The rotary compression spring may be retained in a closed position by a retention tab extending from the main body. The rotary compression spring rotates into an open position that forces the striker bar toward the secondary latch member when the retention tab is urged away from the rotary compression spring.

Figure 1:
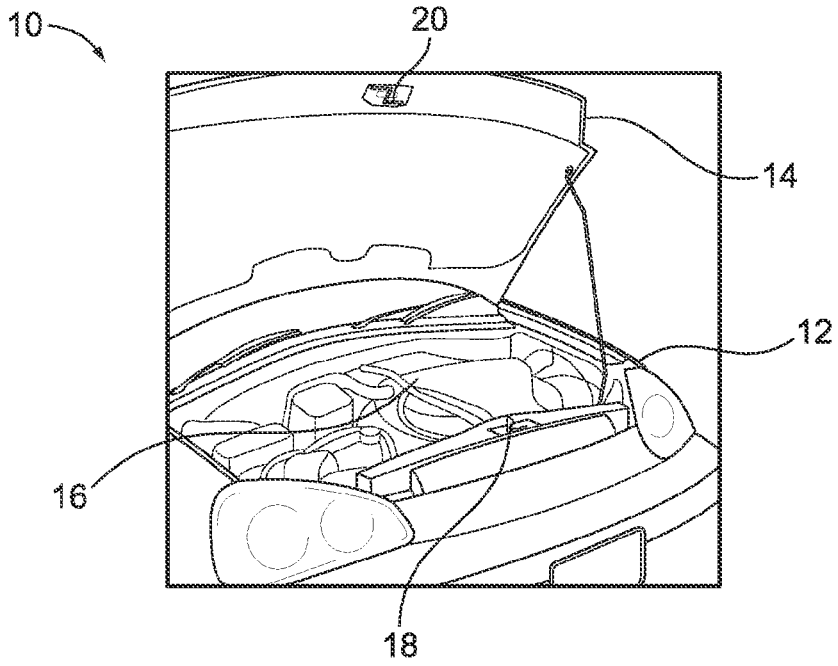
FIG. 1 illustrates an isometric view of a front end of a vehicle.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

Figure 2:
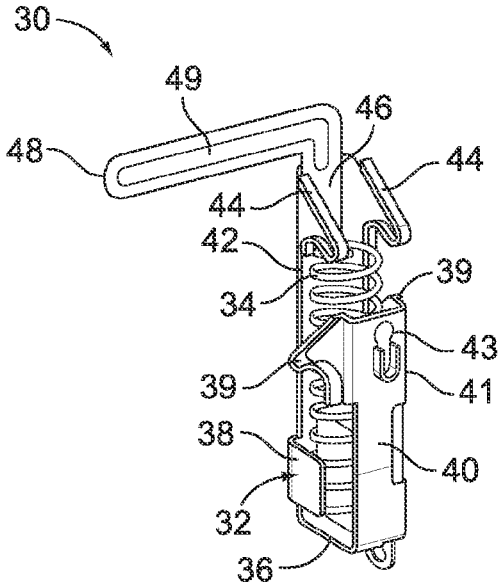
FIG. 2 illustrates an isometric view of a hood latch assembly from a first side, according to an embodiment of the present invention.
Figure 3:
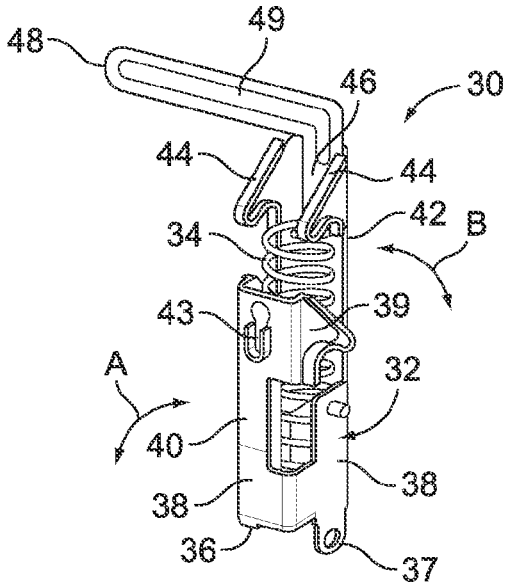
FIG. 3 illustrates an isometric view of a hood latch assembly from a second side, according to an embodiment of the present invention.

FIGS. 2 and 3 illustrate isometric views of a hood latch assembly 30 from first and second sides, respectively, according to an embodiment of the present invention. The assembly 30 includes a main body 32 integrally formed (stamped, for example) from a single piece of material, such as metal, and a coil spring 34 secured within the main body 32. As such, the assembly 30 is formed from only two separate and distinct components: the main body 32 and the coil spring 34.

The coil spring 34 may include multiple springs to accommodate hoods of increased weight. For example, the coil spring 34 may include an outer spring and an inner telescoping spring within the outer spring. The dual spring configuration having inner and outer concentric springs provides a more robust spring constant.

Referring to FIGS. 2 and 3, the main body 32 includes a base 36 integrally connected to fixed upstanding walls 38. A installation tab 37 including a through-hole extends down from the base 36. The main body 32 secures to a frame of a vehicle through the installation tab 37 (such as through a bolt). Notably, typical prior latch assemblies were secured to a frame through two mounting holes. However, the assembly 30 is configured to be securely retained to the frame, by virtue of its simple, longitudinal design, through only one bolt positioned through the through-hole of the installation tab 37.

A primary latch pivot arm 40 is integrally and pivotally connected to at least one of the upstanding walls 38. As such, the primary latch pivot arm 40 is configured to pivot through directions denoted by arc A. At a top end, the primary latch pivot arm 40 includes opposed flanges 39 integrally connected to a main support wall 41. A cable latch hole 43 is formed through the main support wall 41 and is configured to securely retain an end of a cable (not shown) that is operatively connected to a hood release activation handle (not shown).

Additionally, a secondary latch pivot arm 42 is integrally and pivotally connected to at least one of the upstanding walls 38. Accordingly, the secondary latch pivot arm 42 is configured to pivot through directions denoted by arc B. At a top end, the secondary latch pivot arm 42 includes opposed slide ramps 44 integrally connected to a main support wall 46.

A handle 48 extends upwardly and outwardly from the main support wall 46. The handle 48 includes a central stiffening bead or rib 49 that adds strength and robustness to the handle 48.

The coil spring 34 is secured to an interior surface of the base 36, such as through bonding, crimping or the like. As shown in FIGS. 2 and 3, the coil spring 34 is securely retained within the main body 32 between the primary and secondary latch pivot arms 40 and 42, respectively.

Figure 4:
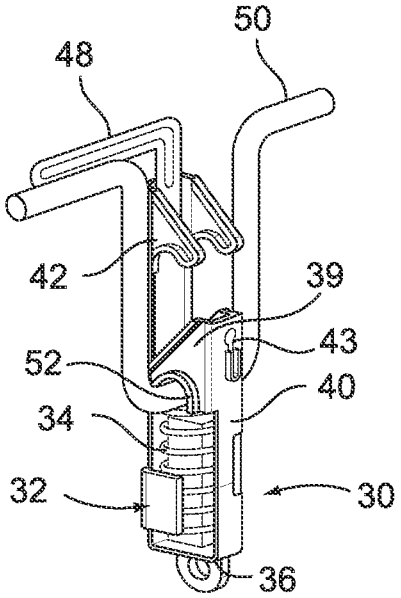
FIG. 4 illustrates an isometric view of a hood latch assembly securing a striker bar in a primary closed position, according to an embodiment of the present invention.
Figure 5:
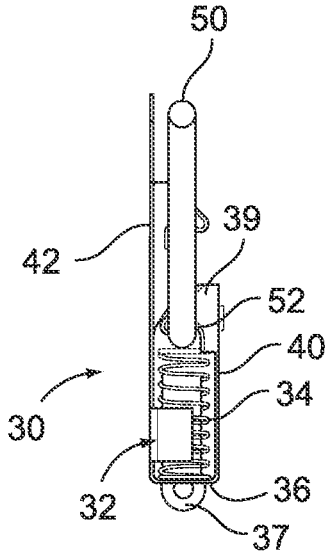
FIG. 5 illustrates a lateral view of a hood latch assembly securing a striker bar in a primary closed position, according to an embodiment of the present invention.

FIGS. 4 and 5 illustrate isometric and lateral views, respectively, of the hood latch assembly 30 securing a striker bar 50 in a primary closed position, according to an embodiment of the present invention. The striker bar 50 extends from an interior surface of a hood (not shown).

As shown in FIGS. 4 and 5, in the fully secured position, the striker bar 50 is urged into clasping lower surfaces 52 of the opposed flanges 39 of the primary latch pivot arm 40. The clasping lower surfaces 52 are shaped to conform to the circumference of the striker bar 50. Because the primary latch pivot arm 40 is in a fully upright position, the striker bar 50 is secured in position, despite the force exerted by the coil spring 34. In order to remove the striker bar 50 from the primary latch pivot arm 40, the primary latch pivot arm 40 is pivoted away from the coil spring 34.

Figure 6:
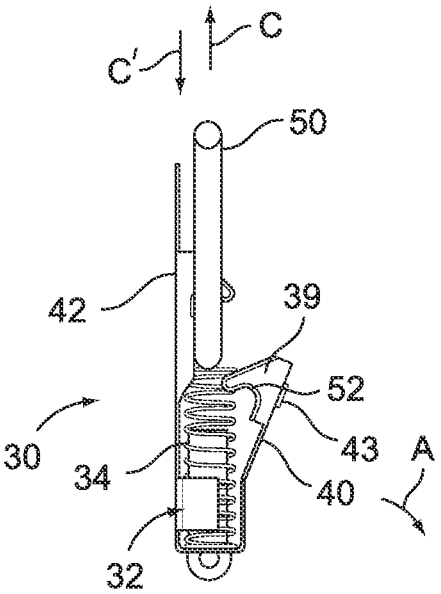
FIG. 6 illustrates a lateral view of a hood latch assembly disengaging a striker bar from a primary closed position, according to an embodiment of the present invention.

FIG. 6 illustrates a lateral view of the hood latch assembly 30 disengaging the striker bar 50 from a primary closed position, according to an embodiment of the present invention. As noted previously, a cable (not shown) is secured to the primary latch pivot arm 40 at the cable latch hole 43. As the cable pulls on the primary latch pivot arm 40, the primary latch pivot arm 40 pivots away from the coil spring 34 in the direction of arc A. As the primary latch pivot arm 40 pivots away, the striker bar 50 loses contact with the clasping lower surfaces 52. As such, the coil spring 34 forces the striker bar 50 up in the direction of arrow C toward the secondary latch pivot arm 42.

Figure 7:
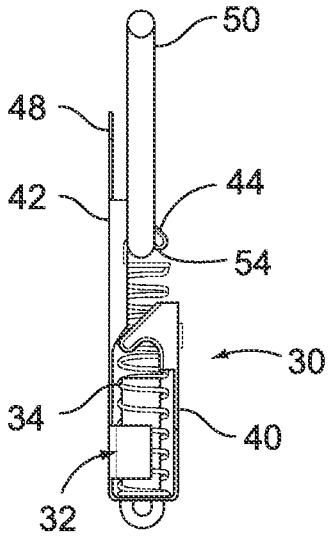
FIG. 7 illustrates a lateral view of a hood latch assembly securing a striker bar in a secondary closed position, according to an embodiment of the present invention.

FIG. 7 illustrates a lateral view of the hood latch assembly 30 securing the striker bar 50 in a secondary closed position, according to an embodiment of the present invention. Due to the coil spring 34, the striker bar 50 is forced past the primary latch pivot arm 40 into clasping lower surfaces 54 of the slide ramps 44. The primary latch pivot arm 40 flexes back to an upright position once the striker bar 50 disengages the primary latch pivot arm 40.

Because the secondary latch pivot arm 42 is in a fully upright position, the striker bar 50 is secured in place by the secondary latch pivot arm 42. In this manner, the hood latch assembly 30 props the hood of a vehicle into a secure, but propped-up, position with respect to the frame. An operator may then slide a hand underneath the hood to engage the handle 48 of the secondary latch pivot arm 42.

Figure 8:
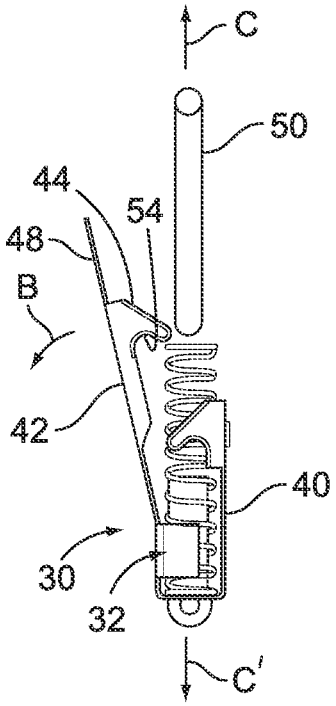
FIG. 8 illustrates a lateral view of a hood latch assembly disengaging a striker bar from a secondary closed position, according to an embodiment of the present invention.

FIG. 8 illustrates a lateral view of the hood latch assembly 30 disengaging the striker bar 50 from a secondary closed position, according to an embodiment of the present invention. As noted above, an operator grasps the handle 48 and pulls the secondary latch pivot arm 42 in the direction of arc B. Accordingly, the secondary latch pivot arm 42 disengages from the striker bar 50, which is forced upward past the slide ramps 44 in the direction of arrow C.

Figure 9:
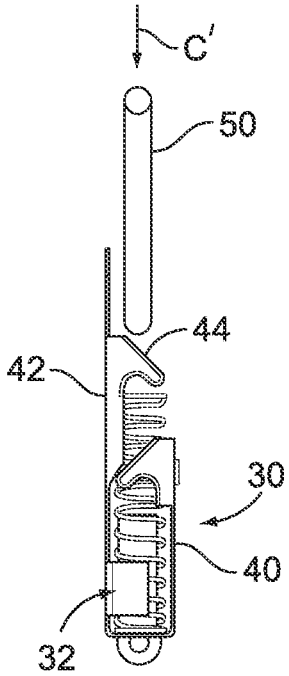
FIG. 9 illustrates a lateral view of a hood latch assembly fully disengaged from a striker bar, according to an embodiment of the present invention.
Figure 10:
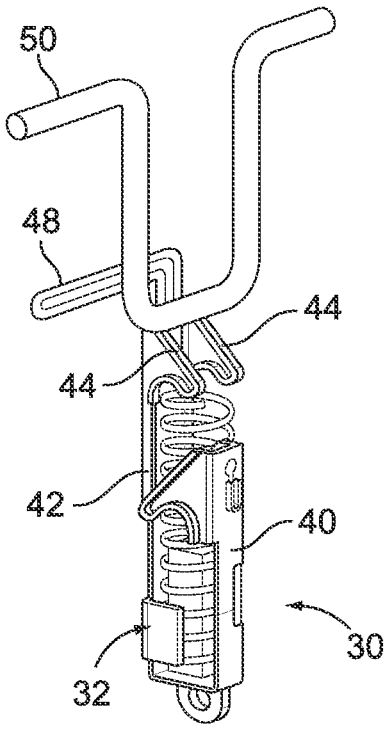
FIG. 10 illustrates an isometric view of a hood latch assembly fully disengaged from a striker bar, according to an embodiment of the present invention.

FIGS. 9 and 10 illustrate lateral and isometric views, respectively, of the hood latch assembly 30 fully disengaged from the striker bar 50, according to an embodiment of the present invention. Referring to FIGS. 9 and 10, the secondary latch pivot arm 42 flexes back to the upright position once the striker bar 50 clears the secondary latch pivot arm 42

When the hood of a vehicle is pivoted back to a closed position, the striker bar 50 moves into the slide ramps 44 of the secondary latch pivot arm 42 in the direction of arrow C'. In this manner, the striker bar 50 forces the secondary latch pivot arm 42 to pivot back.

Referring to FIG. 8, as the striker bar 50 continues to move downwardly in the direction of arrow C' (such as caused by the force of a falling hood), the striker bar 50 slides over the slide ramps 44 and forces the secondary latch pivot arm 42 to pivot away in the direction of arc B. Once the striker bar 50 moves past the secondary latch pivot arm 42, the striker bar 50 is forced into the top of the coil spring 34.

Referring to FIG. 6, with increased movement in the direction of arrow C', the striker bar 50 begins to compress the coil spring 34 and slides over the flanges 39 of the primary latch pivot arm 40. In this manner, the primary latch pivot arm 40 pivots away in the direction of arc A.

Referring to FIGS. 4 and 5, the striker bar 50 continues to be forced down toward the base 36 and clears the primary latch pivot arm 40. Thus, the primary latch pivot arm 40 flexes back to an upright position. The coil spring 34 continues to resist the force of the downwardly-moving striker bar 50, ultimately stopping the downward descent of the striker bar 50. The upward force of the coil spring 34 exerted into the striker bar 50 then lodges the striker bar 50 into the clasping lower surfaces 52 of the flanges 39. Accordingly, the striker bar 50 (and the hood to which it is attached) are secured in position by the hood latch assembly 30.

Thus, embodiments of the present invention provide a simple and efficient hood latch assembly 30.

Figure 11:
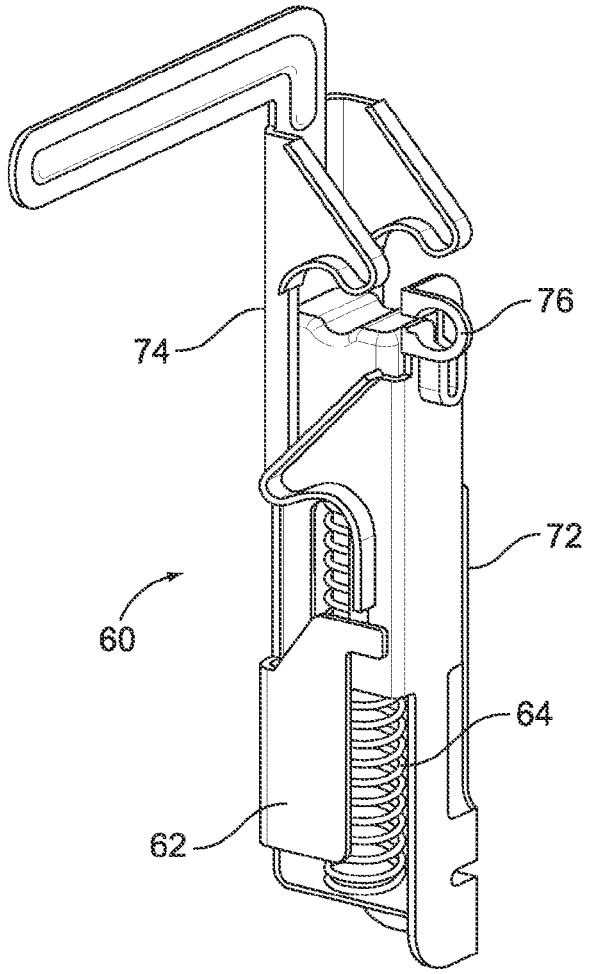
FIG. 11 illustrates an isometric top view of a hood latch assembly from a first side, according to an embodiment of the present invention.

FIG. 11 illustrates an isometric top view of a hood latch assembly 60 from a first side, according to an embodiment of the present invention. The hood latch assembly 60 is similar to the hood latch assembly 30 shown and described with respect to FIGS. 2-10. Features of the hood latch assembly 60 may be incorporated into the hood latch assembly 30, and vice versa. The hood latch assembly 60 includes a main body 62 that retains a plunger 64.

Figure 12:
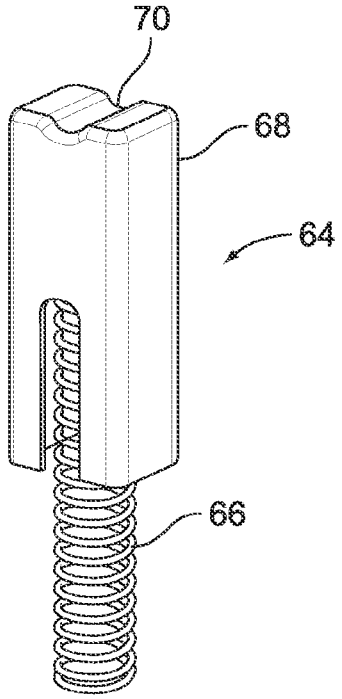
FIG. 12 illustrates an isometric top view of a plunger, according to an embodiment of the present invention.

FIG. 12 illustrates an isometric top view of the plunger 64, according to an embodiment of the present invention. The plunger 64 includes a coil spring 66 secured to a cap 68. The cap 68 is sized and shaped to slidably conform to an interior of the main body 62. A top surface of the cap 68 includes a recessed divot 70 that conforms to the shape and circumference of a striker bar. The cap 68 is therefore configured to provide a cushioned surface for the striker bar.

Figure 13:
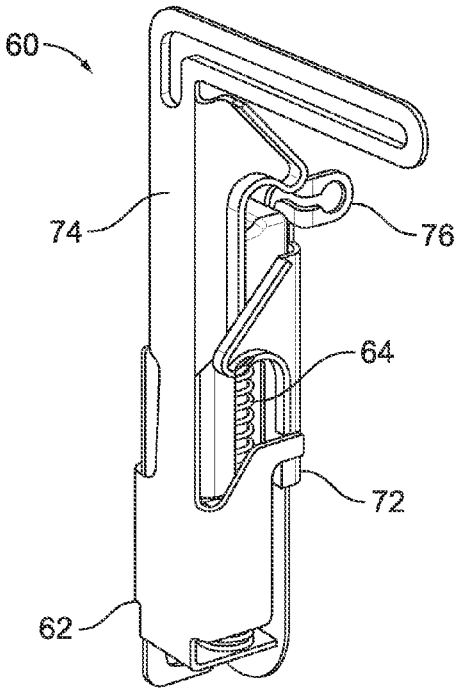
FIG. 13 illustrates an isometric top view of a hood latch assembly from a second side, according to an embodiment of the present invention.

FIG. 13 illustrates an isometric top view of the hood latch assembly 60 from a second side. In the closed position, the primary and secondary latch pivot arms 72 and 74, respectively, interlock with one another, such as through tabs and slots, or the like. In this manner, the assembly 60 is less susceptible to separating during a crash, for example.

Additionally, the primary latch pivot arm 72 includes a cable attachment stud 76 that extends outwardly therefrom (as opposed to a mere opening formed therethrough). As such, a manufacturer may more easily attach a cable to the stud 76.

Figure 14:
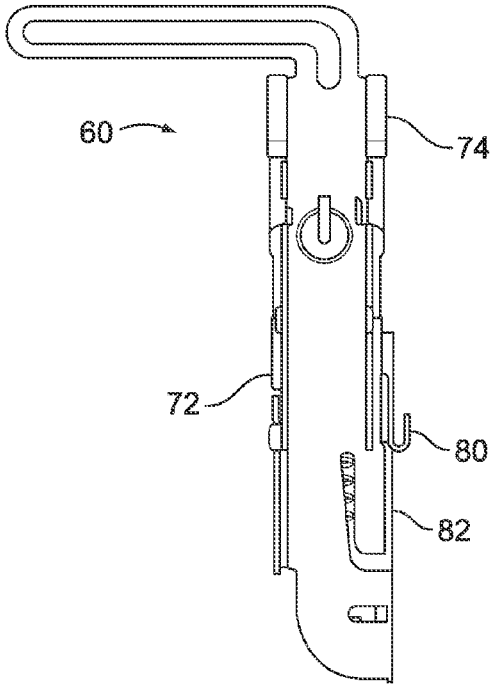
FIG. 14 illustrates a front view of a hood latch assembly, according to an embodiment of the present invention.

FIG. 14 illustrates a front view of the hood latch assembly 60. A hook 80 extends from a wall 82 of the assembly 60. The hook 80 is configured to pass through and latch onto a panel or portion of a vehicle frame, in order to provide a secure alignment with respect to the frame.

Figure 21:
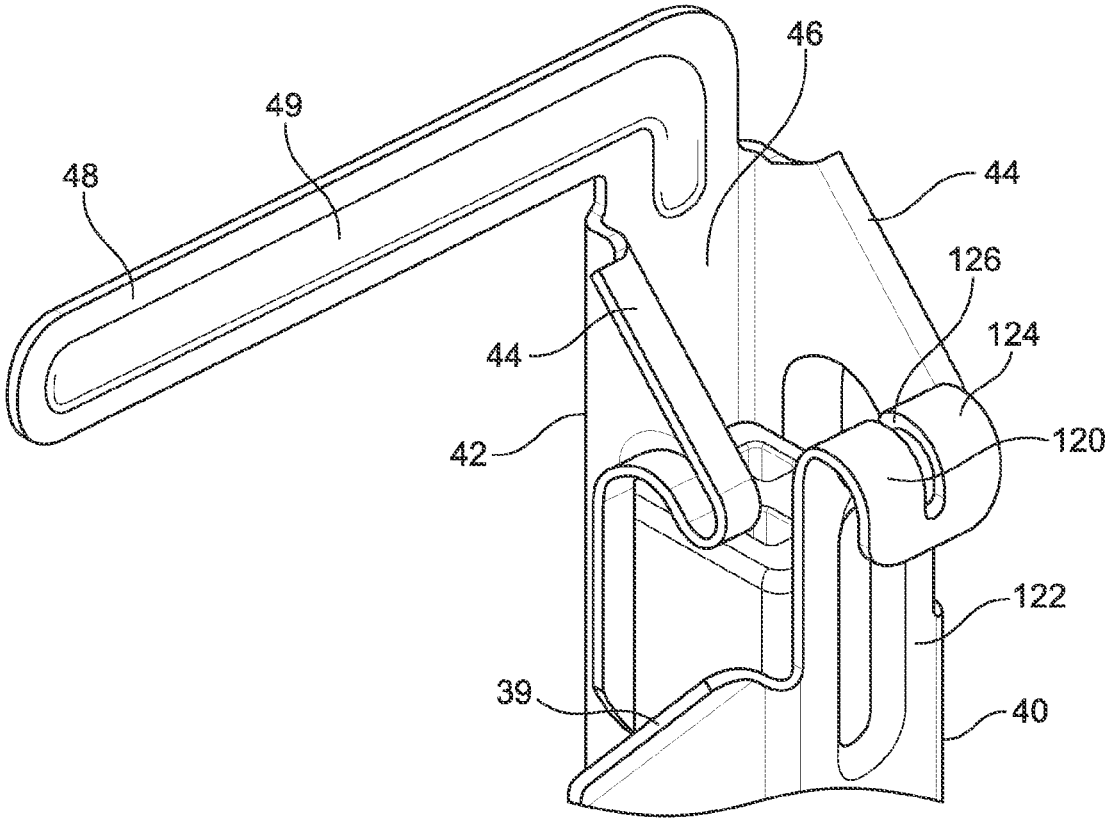
FIG. 21 illustrates an isometric front view of a cable attachment beam, according to an embodiment of the present invention.
Figure 22:
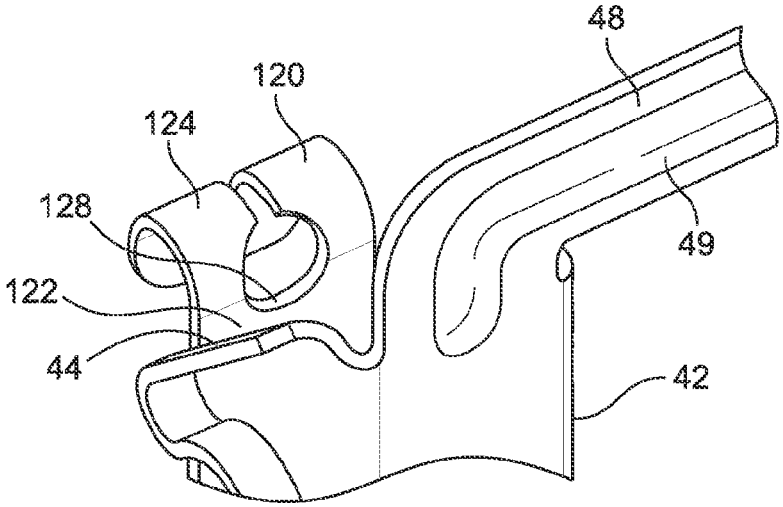
FIG. 22 illustrates an isometric rear view of a cable attachment beam according to an embodiment of the present invention.

FIGS. 21 and 22 illustrate isometric front and rear views, respectively, of a cable attachment beam 120 extending from the primary latch pivot arm 42, according to an embodiment of the present invention. The cable attachment beam 120 may be used in place of the cable latch hole 43 (shown in FIGS. 2 and 3, for example) or the cable attachment stud 76 (shown in FIGS. 11 and 13, for example).

As shown in FIGS. 21 and 22, the cable attachment beam 120 includes a main strap 122 that extends upwardly from the primary latch pivot arm 42. The main strap 122 connects to a curved strap 124 that curves away from the main support wall 46 over an arc of approximately 180° . As shown in FIG. 21, a slit 126 is formed through the curved strap 124. The slit 126 connects to an enlarged opening 128 formed through the main strap 122.

During a manufacturing process, a cable (not shown) is inserted through the enlarged opening 128. The cable may includes a cap, stud, or the like that is larger than the opening 128. As such, the terminal end of the cable is prevented from passing through the opening 128. The cable may then be wrapped around the main strap 122 and/or the curved strap 124 in order to securely anchor the cable to the primary latch pivot arm 42. It has been found that the cable attachment beam 120 provides a more robust connection.

Figure 15:
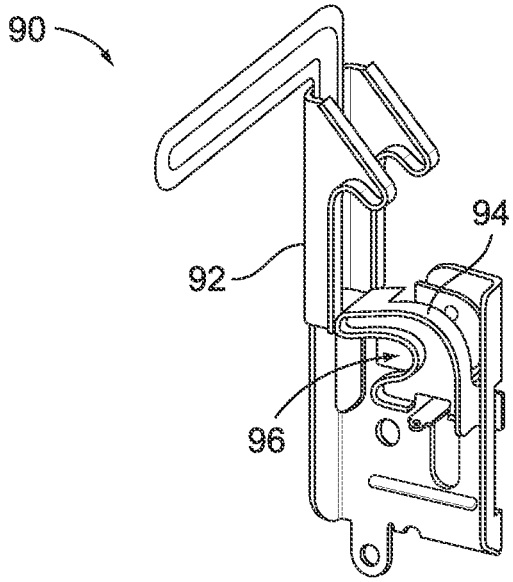
FIG. 15 illustrates an isometric side view of a hood latch assembly in a fully closed position, according to an embodiment of the present invention.

FIG. 15 illustrates an isometric side view of a hood latch assembly 90 in a fully closed position, according to an embodiment of the present invention. The assembly 90 includes a main body 92 integrally formed from a single piece of metal, and a compression spring 94, which may be formed from another piece of metal. The compression spring 94 is rotatably secured to the main body through a rivet or bolt (not shown). In the closed position, the compression spring 94 closes a bar opening 96 formed through the main body 92.

Figure 16:
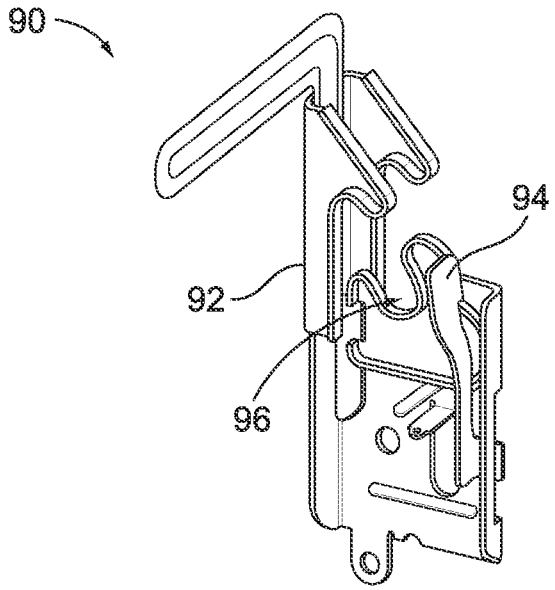
FIG. 16 illustrates an isometric side view of a hood latch assembly disengaged from a primary closed position, according to an embodiment of the present invention.

FIG. 16 illustrates an isometric side view of the hood latch assembly 90 disengaged from a primary closed position, according to an embodiment of the present invention. In the position shown in FIG. 16, the compression spring 94 opens the bar opening 96.

Figure 17:
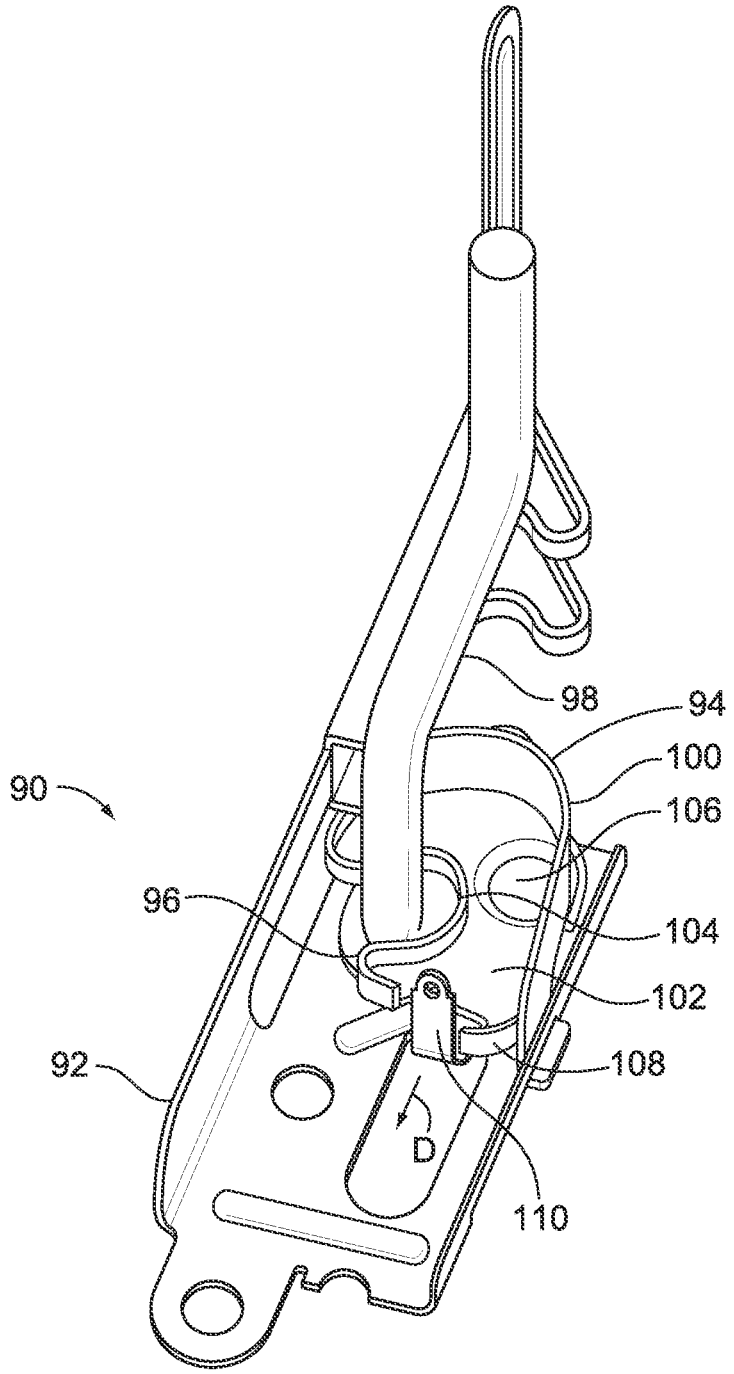
FIG. 17 illustrates an isometric side view of a hood latch assembly fully engaging a striker bar, according to an embodiment of the present invention.

FIG. 17 illustrates an isometric side view of the hood latch assembly 90 fully engaging a striker bar 98, according to an embodiment of the present invention. As shown in FIG. 17, the compression spring 94 includes a strap 100 that integrally and perpendicularly connects to a wall 102. The wall 102 includes an open-ended channel 104 formed therethrough. A pivot hole 106 is formed through the wall 102 proximate the union with the strap 100. The pivot hole 106 is aligned with a pivot hole formed through the main body 92 (the rivet or bolt passes through the aligned pivot holes).

In the primary closed position, the striker bar 98 is retained within the bar opening 96 formed in the main body 92. The open-ended channel 104 secures over the striker bar 98. Therefore, the striker bar 98 is retained between the bar opening 96 and the channel 104.

As shown in FIG. 17, the compression spring 94 also includes a clasp 108 proximate a lower end. The clasp 108 latches onto a moveable retention tab 110 that extends perpendicularly from the main body 92. The retention tab 110 prevents the compression spring 94 from rotating about the pivot hole 106.

In order to disengage the striker bar 98 from the primary closed position, the retention tab 110 is urged downwardly in the direction of arrow D. The retention tab 110 is operatively connected to a cable (not shown) that is, in turn, operatively connected to a hood release activation handle. Once the retention tab 110 is urged downwardly in the direction of arrow D, the retention tab 110 disengages from the clasp 108. Accordingly, the compression spring 94 rotates about the pivot hole 106.

Figure 18:
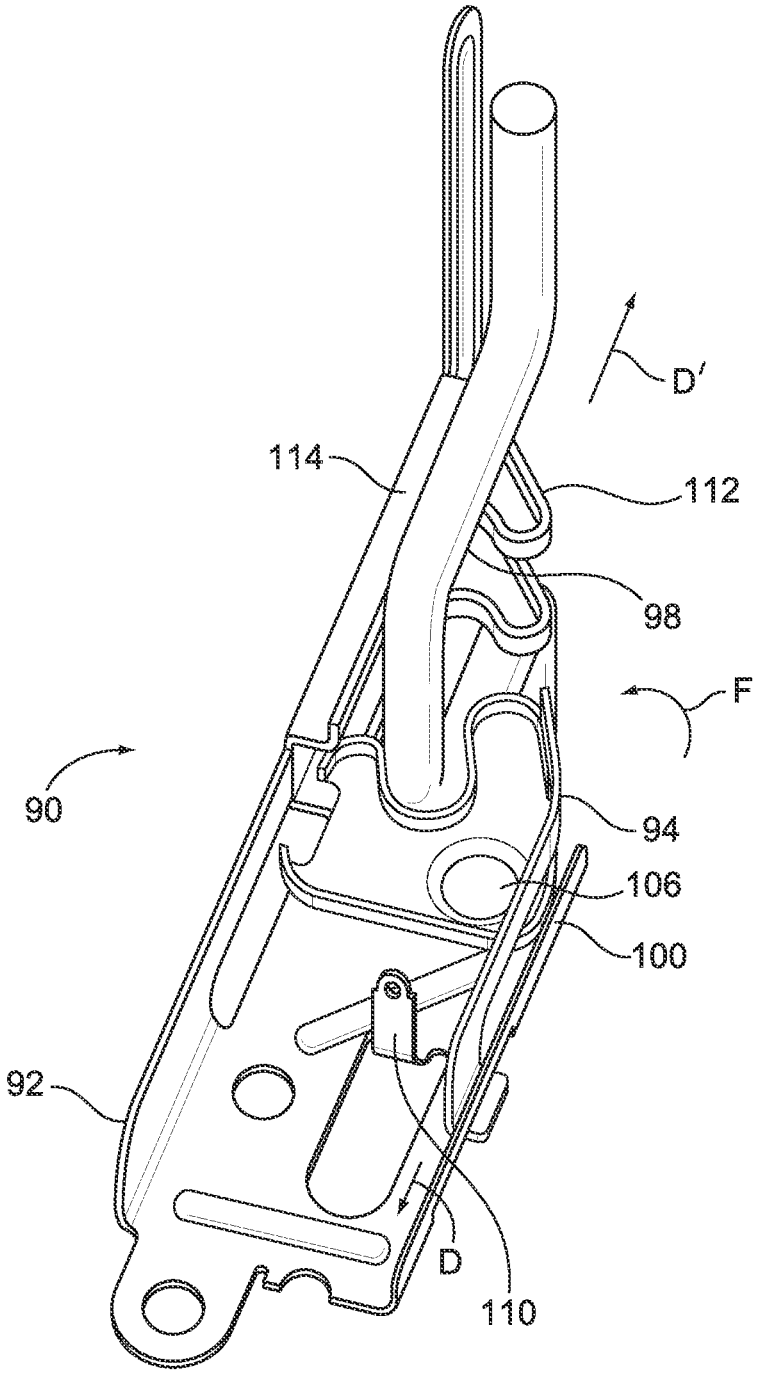
FIG. 18 illustrates an isometric side view of a hood latch assembly disengaging a striker bar from a primary closed position, according to an embodiment of the present invention.

FIG. 18 illustrates an isometric side view of the hood latch assembly 90 disengaging the striker bar 98 from the primary closed position, according to an embodiment of the present invention. Once disengaged from the clasp 108, the retention tab 110 flexes back to its upright position.

The compression spring 94, which may be a leaf or rotary spring, rotates about the pivot hole 106 such that the strap 100 moves down in the direction of arrow D. At this time, the striker bar 50, which is cradled in the channel 104 of the compression spring 94, is forced upwardly in the direction of arrow D' toward slide ramps 112 of a secondary latch pivot arm 114. Similar to the assembly 30, the secondary latch pivot arm 114 retains the striker bar 98 in a position such that the striker bar 98 (and hood) is propped-up.

Figure 19:
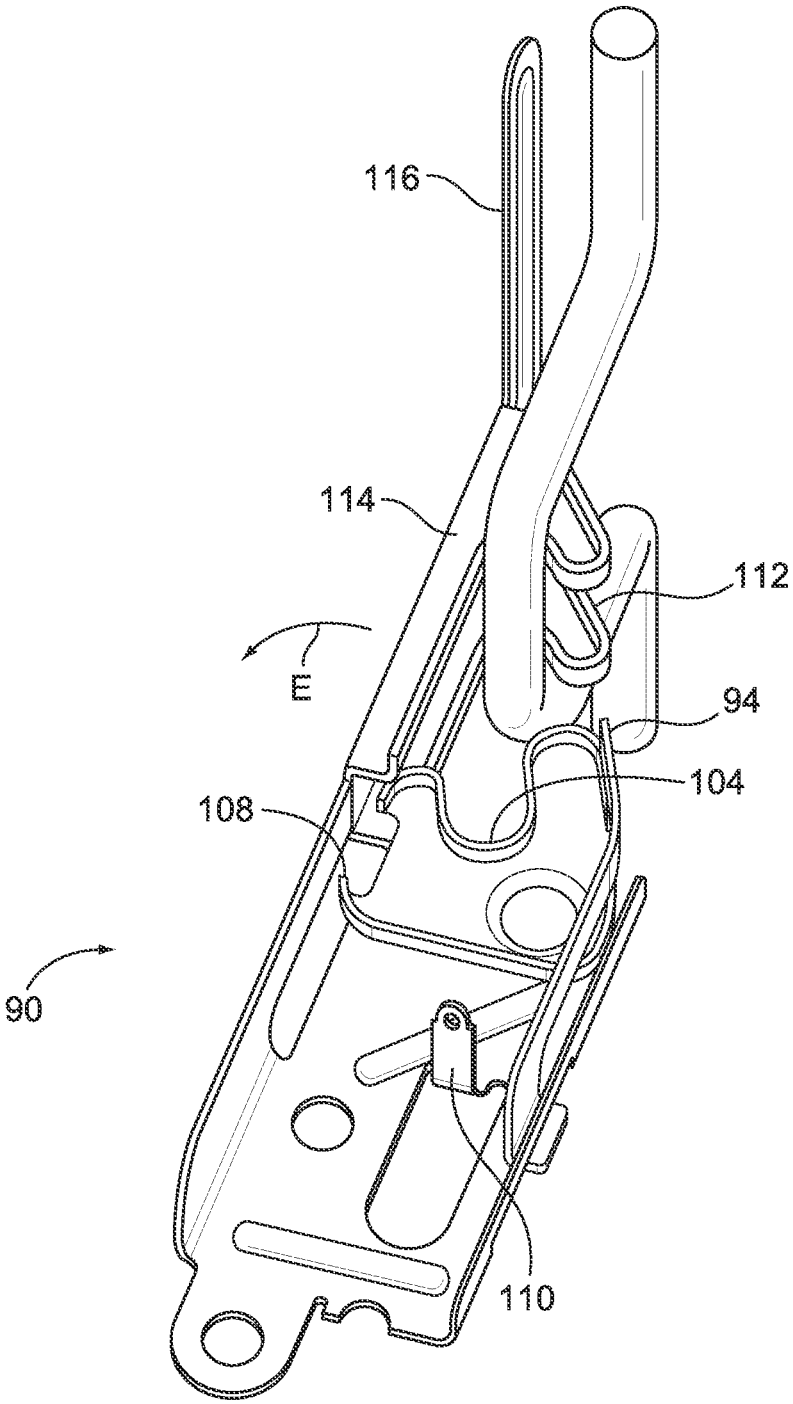
FIG. 19 illustrates an isometric side view of a hood latch assembly securing a striker bar in a secondary closed position, according to an embodiment of the present invention.

FIG. 19 illustrates an isometric side view of the hood latch assembly 90 securing the striker bar 98 in a secondary closed position, according to an embodiment of the present invention. In order to disengage the striker bar from the secondary closed position, an operator grasps the handle 116 of the secondary latch pivot arm 114 and pivots it back in the direction of arrow E. As such, the slide ramps 112 disengage from the striker bar 98, and the striker bar 98 may be removed from the assembly 90 (similar as described above with respect to the assembly 30).

Figure 20:
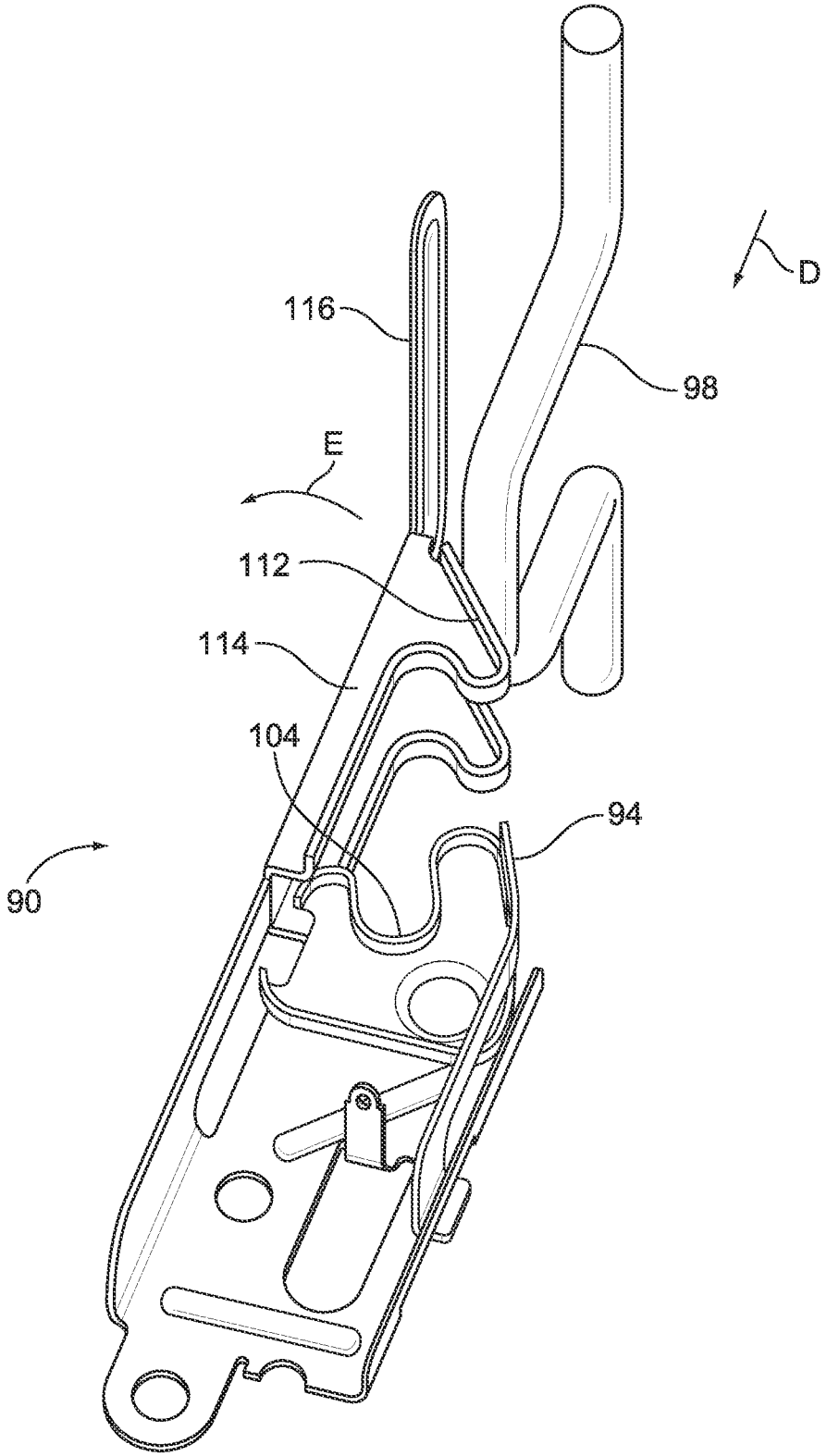
FIG. 20 illustrates an isometric side view of a hood latch assembly fully disengaged from a striker bar, according to an embodiment of the present invention.

FIG. 20 illustrates an isometric side of the hood latch assembly 90 fully disengaged from the striker bar 98, according to an embodiment of the present invention. In order to secure the striker bar 98 within the assembly 90, the striker bar 98 is forced back into the latch assembly in the direction of arrow D. In this manner, the striker bar 98 slides over the slide ramps 112, forcing the secondary latch pivot arm to pivot back in the direction of arc E, as shown in FIG. 19.

As the force of the moving striker bar 98 hits the portion of the compression spring 94 defining the open-ended channel 104 as shown in FIG. 18, the moving striker bar 98 forces the compression spring 94 to rotate about the pivot hole 106 in the direction of arc F, thereby forcing the striker bar 98 back into the bar opening 96 of the main body 92, which is then closed by rotation of the compression spring 94, as shown in FIG. 17.

Therefore, the assembly 90 provides a simple and efficient hood latch assembly that includes an integral main body and a compression spring rotatably secured to the main body.

Thus, the embodiments of the present invention described with respect to FIGS. 2-20 provide a hood latch assembly having a simpler and more efficient design than prior hood latches. Embodiments of the present invention provide a hood latch assembly that retains and holds a hood closed during driving, allows the hood to be opened into a secondary position, helps lift the weight of the hood open to allow a person to open the hood from the secondary position, and allows the hood to be securely closed from the open position.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A hood latch assembly configured to securely latch a striker bar of a hood to a main frame of a vehicle, the hood assembly comprising:

a main body including a moveable secondary latch pivot arm, wherein said secondary latch pivot arm comprises opposed slide ramps and an integral handle, wherein said secondary latch pivot arm is configured to pivot away from said main body when an operator grasps and pulls said integral handle away from said main body; and a moveable primary latch member, wherein said primary latch member is configured to secure the striker bar in a primary closed position, wherein said main body, said secondary latch pivot arm, and said primary latch member are integrally formed as a single piece from a single piece of material, wherein the secondary latch pivot arm and the primary latch member can flexibly bend with respect to the main body without a pivot pin, and wherein said secondary latch pivot arm is configured to secure the striker bar in a secondary closed position above said primary latch member.

2. The hood latch assembly of claim 1, further comprising a coil spring retained within said main body, wherein said coil spring is configured to exert a resistive force into the striker bar.

3. The hood latch assembly of claim 2, further comprising a cushioning cap secured to a top of said coil spring.

4. The hood latch assembly of claim 1, wherein said primary latch member comprises opposed flanges, wherein said primary latch member is configured to pivot away from said main body when pulled by a cable that is operatively connected to a hood release activation handle.

5. The hood latch assembly of claim 1, wherein said primary latch member is configured to pivot away from said main body in a first direction to disengage the striker bar, and said secondary latch member is configured to pivot away from said main body in a second direction to disengage the striker bar, wherein the first direction is opposite that of the second direction.

6. The hood latch assembly of claim 1, wherein said main body securely fastens to the main frame of the vehicle through a single bolt.

7. The hood latch assembly of claim 1, wherein said primary latch member and secondary latch pivot arm are configured to interlock with one another when the striker bar is fully engaged by said primary latch member.

8. The hood latch assembly of claim 1, wherein said primary latch member comprises a cable attachment member.

9. The hood latch assembly of claim 8, wherein said cable attachment member comprises a main strap integrally connected to a curved strap, and wherein a slit formed through said curved strap connects to an expanded opening formed through said main strap.

10. The hood latch assembly of claim 1, wherein said primary latch member comprises a rotary compression spring.

11. The hood latch assembly of claim 10, wherein said rotary compression spring is retained in a closed position by a retention tab extending from said main body.

12. The hood latch assembly of claim 11, wherein said rotary compression spring rotates into an open position that forces the striker bar toward the secondary latch pivot arm when s a id retention tab is urged away from said rotary compression spring.

13. A hood latch assembly configured to securely latch a striker bar of a hood to a main frame of a vehicle, the hood assembly comprising:

a main body including a secondary latch pivot arm, wherein said secondary latch pivot arm includes opposed slide ramps and an integral handle, wherein said secondary latch pivot arm is configured to pivot away from said main body; and a primary latch member, wherein said primary latch member is configured to secure the striker bar in a primary closed position, wherein said main body, said secondary latch pivot arm, and said primary latch member are integrally formed as a single piece from a single piece of material, wherein the secondary latch pivot arm and the primary latch member can flexibly bend with respect to the main body without a pivot pin, and wherein said secondary latch pivot arm is configured to secure the striker bar in a secondary closed position above said primary latch member.

14. The hood latch assembly of claim 13, further comprising a coil spring retained within said main body, wherein said coil spring is configured to exert a resistive force into the striker bar.

15. The hood latch assembly of claim 14, further comprising a cushioning cap secured to a top of said coil spring.

16. The hood latch assembly of claim 13, wherein said primary latch member comprises a primary latch pivot arm having opposed flanges, wherein said primary latch pivot arm is configured to pivot away from said main body when pulled by a cable that is operatively connected to a hood release activation handle, wherein said primary latch pivot arm is configured to pivot away from said main body in a first direction to disengage the striker bar, and said secondary latch pivot arm is configured to pivot away from said main body in a second direction to disengage the striker bar, wherein the first direction is opposite that of the second direction.

17. The hood latch assembly of claim 13, wherein said primary latch member comprises a rotary compression spring, wherein said rotary compression spring is retained in a closed position by a retention tab extending from said main body, and wherein said rotary compression spring rotates into an open position that forces the striker bar toward the secondary latch member when said retention tab is urged away from said rotary compression spring.

18. A hood latch assembly configured to securely latch a striker bar of a hood to a main frame of a vehicle, the hood assembly comprising:

a main body including an integrally-formed moveable secondary latch pivot arm, wherein said secondary latch pivot arm includes opposed slide ramps and an integral handle, wherein said secondary latch pivot arm is configured to pivot away from said main body when an operator grasps and pulls said integral handle away from said main body, wherein said main body securely fastens to the main frame of the vehicle through a single fastener;

a moveable primary latch pivot arm, wherein said main body, said secondary latch pivot arm, and said primary latch member are integrally formed as a single piece from a single piece of material, wherein the secondary latch pivot arm and the primary latch member can flexibly bend with respect to the main body without a pivot pin, wherein said primary latch pivot arm includes opposed flanges, wherein said primary latch pivot arm is configured to pivot away from said main body when pulled by a cable that is operatively connected to a hood release activation handle; and a coil spring retained within said main body, wherein said coil spring is configured to exert a resistive force into the striker bar, wherein said primary latch pivot arm is configured to secure the striker bar in a primary closed position, and wherein said secondary latch member is configured to secure the striker bar in a secondary closed position above said primary latch member, wherein said primary latch pivot arm is configured to pivot away from said main body in a first direction to disengage the striker bar, and said secondary latch pivot arm is configured to pivot away from said main body in a second direction to disengage the striker bar, wherein the first direction is opposite that of the second direction.

* * * * *